US009862574B2

(12) United States Patent
Lehtinen et al.

(10) Patent No.: US 9,862,574 B2
(45) Date of Patent: Jan. 9, 2018

(54) ELEVATOR ROPING ARRANGEMENT AND METHOD FOR INSTALLING ROPING OF AN ELEVATOR

(71) Applicant: KONE CORPORATION, Helsinki (FI)

(72) Inventors: Hannu Lehtinen, Numminen (FI); Jarmo Reijonen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/950,646

(22) Filed: Nov. 24, 2015

(65) Prior Publication Data

US 2016/0145077 A1 May 26, 2016

(30) Foreign Application Priority Data

Nov. 25, 2014 (EP) ..... 14194645

(51) Int. Cl.
*B66B 19/02* (2006.01)
*B66B 7/06* (2006.01)

(52) U.S. Cl.
CPC ..... *B66B 19/02* (2013.01); *B66B 7/06* (2013.01); *B66B 7/068* (2013.01)

(58) Field of Classification Search
CPC .. B66B 7/06; B66B 7/062; B66B 7/10; B66B 19/02
See application file for complete search history.

(56) References Cited

U.S. PATENT DOCUMENTS 657,380 A * 9/1900 Baldwin et al. ..... B66B 11/009 187/265
2,961,216 A * 11/1960 Blair ..... B66B 7/06 187/258

(Continued)

FOREIGN PATENT DOCUMENTS

EP 1 724 229 A1 11/2006
EP 2 589 562 A1 5/2013

(Continued)

*Primary Examiner* — Minh Truong
(74) *Attorney, Agent, or Firm* — Birch, Stewart, Kolasch & Birch, LLP

(57) ABSTRACT

An arrangement for installing a set of elevator ropes includes one or more rope reels storing the set of elevator ropes, a rope wheel arrangement mounted on a fixed base comprising one or more rope wheels, a first rope guide detachably mounted in proximity of said one or more rope wheels of the rope wheel arrangement, and a second rope guide detachably mounted in proximity of said one or more rope wheels of the rope wheel arrangement. The ropes of the set of elevator ropes are arranged to pass from the one or more rope reels to said one or more rope wheels of the rope wheel arrangement via the first rope guide, which is arranged to guide the ropes to converge a rim of said one or more rope wheels at least substantially vertically, to turn around said one or more rope wheels, and to pass away from the one or more rope wheels via the second rope guide, which is arranged to guide the ropes to diverge from a rim of said one or more rope wheels at least substantially vertically. A method for installing a set of elevator ropes uses the disclosed arrangement.

16 Claims, 5 Drawing Sheets

(56) References Cited

U.S. PATENT DOCUMENTS

| | | | | | |
|---|---|---|---|---|---|
| 3,666,051 | A * | 5/1972 | Davis | B66B 7/06 | 187/239 |
| 5,025,893 | A * | 6/1991 | Saito | B66B 15/02 | 187/266 |
| 5,435,417 | A * | 7/1995 | Hakala | B66B 11/0055 | 187/266 |
| 5,513,903 | A * | 5/1996 | Mraz | E21C 41/16 | 187/405 |
| 6,193,017 | B1 * | 2/2001 | Koster | B66B 7/10 | 187/256 |
| 8,556,040 | B2 * | 10/2013 | Fargo | B66B 7/062 | 187/251 |
| 2007/0062762 | A1 * | 3/2007 | Ach | B66B 7/062 | 187/266 |
| 2012/0291395 | A1 * | 11/2012 | Plathin | B66B 19/02 | 52/741.1 |
| 2013/0133983 | A1 * | 5/2013 | Mangini | B66B 5/021 | 187/277 |
| 2014/0231179 | A1 * | 8/2014 | Alasentie | B66B 11/0045 | 187/251 |
| 2015/0034425 | A1 * | 2/2015 | Ratia | B66B 7/06 | 187/249 |
| 2015/0122588 | A1 * | 5/2015 | Kalliomaki | B66B 7/068 | 187/264 |
| 2016/0318738 | A1 * | 11/2016 | Alasentie | B66B 19/02 | |

FOREIGN PATENT DOCUMENTS

| | | | |
|---|---|---|---|
| EP | 2 749 519 | A1 | 7/2014 |
| WO | WO 2009/090299 | A1 | 7/2009 |

* cited by examiner

ELEVATOR ROPING ARRANGEMENT AND METHOD FOR INSTALLING ROPING OF AN ELEVATOR

FIELD OF THE INVENTION

The invention relates to an arrangement and a method for installing a set of ropes of an elevator for transporting passengers and/or goods.

BACKGROUND OF THE INVENTION

An elevator typically comprises an elevator car and a counterweight, which are vertically movable in a hoistway. These elevator units are interconnected by first ropes (later referred to as suspension ropes or upper ropes) that suspend these elevator units on opposite sides of rope wheels mounted higher than the elevator units. Additionally, the elevator may need to be provided with second ropes between the elevator car and the counterweight, which second ropes hang from the elevator car and the counterweight (later also referred to the lower ropes). This type of arrangement is normally used to provide compensation for the weight of the hoisting ropes and/or to provide some other function of the elevator such as a so called tie-down-function of the elevator.

In prior art, elevator ropes have been installed by first providing a reel and thereafter guiding the ropes to pass around the rope wheels. In the field of elevators, ropes typically comprise load bearing members made of twisted wires or equivalents. This type of ropes are typically irreversibly flexible such that after the rope has been bent into a curve, it does not reverse back to its original form by itself. This results largely from internal friction and twisted structure of the rope. Also such ropes have been proposed, which are rod-like and take a straight form when in rest state. A this kind of rope is presented in patent publication WO2009090299 A1. This kind of ropes are relatively rigid, but elastically bendable, whereby the rope self-reverses back to a straight form from bent form in rest state after all bending directed to it ceases. In general, ropes which tend to reverse back to straight form are difficult to handle. This type of ropes have now been noticed to cause special challenges in the installation process.

The above mentioned challenges regarding handling and installing of rigid ropes has been further noticed to be particularly relevant when roping elevators where the guidance by the rope wheels is not strong. It has been noted, that one such solution where the installation is particularly challenging, is where the ropes are belt-like and guided by cambered circumference of the rope wheel(s), as this type of guidance requires a long contact as well as firm pressure between the rope wheel and the rope.

BRIEF DESCRIPTION OF THE INVENTION

The object of the invention is to introduce an arrangement and a method for installing a set of elevator ropes wherein the installation procedure is improved in terms of control of the ropes during the moving of the ropes in their longitudinal direction from rope reels into the elevator system, and particularly around rope wheels of the elevator system. An object is furthermore to introduce an arrangement and a method suitable for solving problems caused by the tendency of the ropes to straighten. Improvements are presented, inter alia, which can be utilized effectively with ropes that are rods having a straight form when in rest state and elastically bendable away from the straight form. Improvements are presented, inter alia, which enable use of means for guiding the rope which are sensitive for disturbances during the movement of the rope. In particular, improvements are presented, which enable use of a cambered shape of the rope wheels for guiding the ropes during the installation. Advantageous embodiments are presented, inter alia, wherein a long contact as well as firm pressure between the rope wheel and the rope being installed are achieved.

It is brought forward a new arrangement for installing a set of elevator ropes, the arrangement comprising one or more rope reels storing the set of elevator ropes; and a rope wheel arrangement mounted on a fixed base comprising one or more rope wheels; and a first rope guide detachably mounted in proximity of said one or more rope wheels of the rope wheel arrangement; and a second rope guide detachably mounted in proximity of said one or more rope wheels of the rope wheel arrangement; and wherein the ropes of the set of elevator ropes are, in following order, arranged to pass from the one or more rope reels to said one or more rope wheels of the rope wheel arrangement via the first rope guide, which is arranged to guide the ropes to converge a rim of said one or more rope wheels at least substantially vertically, i.e. in at least substantially vertical direction; and to turn around said one or more rope wheels; and to pass away from the one or more rope wheels via the second rope guide, which is arranged to guide the ropes to diverge from a rim of said one or more rope wheels at least substantially vertically. In this way, rope guidance can be improved for the time of the installation. Particularly, one or more of the above mentioned advantages/objects are realized. Inter alia, ropes can be guided to arrive and leave said one or more rope wheels in a direction facilitating formation of a long contact length and firm of pressure between the rope wheel and the rope.

In a preferred embodiment, each rope, in particular an end thereof, is connected to the counterweight or to a rope lifting means suitable for lifting the ropes in the hoistway for producing pulling effect on the ropes. Thus, rope can be unwound and run via the arrangement effectively. Said end of the rope is the 'first' end of the rope, which is positioned on opposite side of the arrangement than the rope reels. Each rope is such that it has two ends. The 'second' end of each rope is on one of said rope reels.

In a preferred embodiment, each rope is a rod having a straight form when in rest state and elastically bendable away from the straight form. This kind of ropes would otherwise be difficult to guide around rope wheels. By arranging the ropes to pass via the rope guides in the defined way, this kind of ropes can be guided to arrive and leave said one or more rope wheels in a direction facilitating formation of a long contact length and high pressure between the rope wheel and the rope, which would not otherwise be possible. This particular kind of rope, when passing in this way, furthermore produces the synergy that the straightening effect keeps the rope accurately positioned and compressed against the rope wheels and rope guides regardless of gravity or possible lack of rope tension. The tendency of the ropes to straighten thus facilitates the guidance of the ropes along the rope wheels. Owing to this phenomenon, means for guiding the rope which are sensitive for disturbances during the movement of the rope, can be utilized, such as cambered shape, which is particularly demanding with respect to contact pressure and contact length of the rope and the rope wheels.

In a preferred embodiment, said one or more rope wheels are cambered rope wheels comprising a cambered circumferential rope contact area for each of said ropes, and the ropes are arranged to pass against said cambered circumferential rope contact areas. By arranging the ropes to pass via the rope guides in the defined way, the ropes can be guided to arrive and leave said one or more cambered rope wheels in a direction facilitating formation of a long contact length and high contact pressure between the rope wheel and the rope, which are particularly critical for the guidance of ropes by cambered shape.

In a preferred embodiment, the first rope guide comprises one or more guide rollers with which it is arranged to guide the ropes to converge a rim of a rope wheel belonging to said one or more rope wheels at least substantially vertically, and the second rope guide comprises one or more guide rollers with which it is arranged to guide the ropes to diverge from a rim of a rope wheel belonging to said one or more rope wheels at least substantially vertically. Thus, the rope guides can guide the ropes effectively without damaging them.

In a preferred embodiment, the first and second rope guide are arranged to limit, in particular with one or more guide rollers thereof, the horizontal distance between the sections of each rope on opposite sides (before and after) of the one or more rope wheels to be less than the horizontal distance between the opposite rim sides of the one or more rope wheels. This produces an effect, where pressure and length of contact are ensured even without tensioning of the rope e.g. by great longitudinal pull thereof. Thus, the pressure and length of contact can be made adequate for even the most sensitive means of guidance of the rope, such as for guidance of the ropes by a cambered shape of each rope wheel. Guidance then starts to operate reliably even without having great tension on the rope itself. This effect is the most considerable with ropes tending to straighten when in rest state. The effect is maximized with a rope which is a rod having a straight form when in rest state and elastically bendable away from the straight form as specified elsewhere in the application.

In a preferred embodiment, said one or more guide rollers of the first rope guide as well as said one or more guide rollers of the second rope guide comprise a guide roller for limiting the horizontal distance between the sections of each rope on opposite sides (before and after) of the one or more rope wheels, each of which guide rollers for limiting said horizontal distance is mounted at least partially on top of said one or more rope wheels (in particular such that their vertical projections at least partially overlap), and the rope is arranged to pass to the one or more rope wheels as well as away from said the one or more rope wheels between said guide rollers for limiting said horizontal distance.

In a preferred embodiment, said one or more guide rollers of the first rope guide comprise rollers having parallel rotational axis (horizontal) with each other and with said one or more rope wheels and delimiting a gap in thickness direction of the ropes via which the ropes are arranged to pass from the one or more rope reels to said one or more rope wheels, and said one or more guide rollers of the second rope guide comprise rollers having parallel rotational axis with each other and with said one or more rope wheels and delimiting a gap in thickness direction of the ropes via which the ropes are arranged to pass away from the one or more rope wheels.

In a preferred embodiment, said one or more guide rollers of the first rope guide comprise rollers having parallel (horizontal) rotational axis with each other and orthogonal with said one or more rope wheels and delimiting a gap in width direction of the ropes via which the ropes are arranged to pass from the one or more rope reels to said one or more rope wheels, and said one or more guide rollers of the second rope guide comprise rollers having parallel rotational axis with each other and orthogonal with said one or more rope wheels and delimiting a gap in width direction of the ropes via which the ropes are arranged to pass away from the one or more rope wheels.

In a preferred embodiment, said fixed base is the floor of the hoistway

In a preferred embodiment, the rope wheel arrangement comprises a frame mounted on the fixed base, such as a fixed structure of the hoistway (preferably the floor of the hoistway), on which the one or more rope wheels, as well as the first rope guide and the second rope guide are mounted In a preferred embodiment, the first rope guide and the second rope guide comprise each a support frame via which it is detachably mounted on the frame.

In a preferred embodiment, for providing said detachability, the arrangement comprises releasable tightening means (such as bolts and nuts) for each of said rope guides, by which releasable tightening means the guide is detachably mounted/mountable in its mounting position, such as on a frame of the rope wheel arrangement provided with structure (such as holes for receiving bolts of the releasable tightening means) forming counterpart for said tightening means (such as bolts). When detaching the rope guide, said releasable tightening means are released.

In a preferred embodiment, the position of both the first rope guide and the second rope guide is adjustable. For this purpose the frame preferably comprises several mounting locations where the rope guides can be mounted. Owing to this adjustability, the rope guides can be installed to guide the ropes to converge/diverge from a rim of said one or more rope wheels in optimal angle. The same structure is thus also adaptable to work in several different elevator solutions. The adjustability is preferably provided such that the frame of the rope wheel arrangement comprises holes for receiving bolts of a releasable tightening means, which holes are elongated in horizontal direction. Preferably, the horizontal distance between the first rope guide and the second rope guide is adjustable.

In a preferred embodiment, each rope guide is detachably mounted on the frame of the rope wheel arrangement.

In a preferred embodiment, said rope wheels are the lower rope wheels of the elevator mounted in proximity of the lower end of the hoistway.

In the final elevator obtained with the method they are mounted lower than (i.e. in a lower position than) the car and the counterweight. The first rope guide is arranged to guide the ropes to converge a rim of said one or more rope wheels at least substantially vertically from above, and the second rope guide is arranged to guide the ropes to diverge from a rim of said one or more rope wheels at least substantially vertically upwards.

It is also brought forward a new method for installing a set of elevator ropes to pass around one or more rope wheels of a rope wheel arrangement mounted on fixed base, in which method one or more rope reels storing the set of elevator ropes are provided; and thereafter the ropes of the set of elevator ropes are arranged to pass from the one or more rope reels to said one or more rope wheels of the rope wheel arrangement via a first rope guide detachably mounted in proximity of said one or more rope wheels of the rope wheel arrangement; and to turn around said one or more rope wheels; and to pass away from the one or more rope wheels via a second rope guide detachably mounted in proximity of said one or more rope wheels of the rope wheel arrangement;

wherein the ropes are guided to converge the rim of said one or more rope wheels at least substantially vertically with said first rope guide, and to diverge from the rim of said one or more rope wheels at least substantially vertically with the second rope guide; and thereafter the ropes are pulled such that they run via said rope wheel arrangement; and thereafter the first and second rope guide are detached and removed.

In a preferred embodiment, during said pulling, at the same time rope is unwound from said one or more rope wheels.

In a preferred embodiment, each rope is a rod having a straight form when in rest state and elastically bendable away from the straight form.

In a preferred embodiment, the first rope guide comprises one or more guide rollers with which the ropes are guided to converge the rim of a rope wheel belonging to said one or more rope wheels at least substantially vertically, and the second rope guide comprises one or more guide rollers with which the ropes are guided to converge the rim of a rope wheel belonging to said one or more rope wheels at least substantially vertically.

In a preferred embodiment, the horizontal distance of the sections of each rope on opposite sides (before and after) of the one or more rope wheels the first and second rope guide is limited with the rope guides, particularly with one or more guide rollers thereof, to be less than the horizontal distance between the opposite rim sides of the one or more rope wheels.

In a preferred embodiment, said one or more guide rollers of the first rope guide and said one or more guide rollers of the second rope guide comprise a guide roller for limiting the horizontal distance of the sections of each rope on opposite sides (before and after) of the one or more rope wheels, each of which guide rollers for limiting said horizontal distance is mounted at least partially on top of said one or more rope wheels (in particular such that their vertical projections at least partially overlap), and the rope is arranged to pass to the one or more rope wheels as well as away from said one or more rope wheels between said guide rollers for limiting said horizontal distance.

In a preferred embodiment, in the method each rope is connected on one side of the arrangement to the counterweight and on the other side to the elevator car.

In a preferred embodiment, in the method, particularly after ropes have been connected with the elevator car and counterweight, the rope guides are detached from the frame of the rope wheel arrangement and removed from the site.

In a preferred embodiment, each rope is connected to the counterweight or to a rope lifting means, and thereafter said pulling is carried out by moving the counterweight or the rope lifting means vertically in the hoistway for producing pulling effect on the ropes.

In a preferred embodiment, said one or more rope wheels are cambered rope wheels for guiding the ropes to a correct path in their axial direction comprising a cambered circumferential rope contact area for each of said ropes, and the ropes are arranged to pass against said cambered circumferential rope contact areas.

In a preferred embodiment, the set of elevator ropes comprises one or plural ropes.

In a preferred embodiment, said rope comprises one or more load bearing members extending parallel to the longitudinal direction of the rope unbroken throughout the length of the rope, which one or more load bearing members is/are made of composite material comprising reinforcing fibers in polymer matrix, said reinforcing fibers preferably being carbon fibers. Said reinforcing fibers are preferably carbon fibers due to their excellent properties in elevator use, but alternatively some also other fibers could be used, such as glass fibers. With composite material as defined, and particularly in the case of carbon fibers, the tendency to straighten is particularly strong, whereby in this context the measures for alleviating the problems of straightening of rope during installation are particularly advantageous. More precisely, each of these ropes is preferably a rod having a straight form when in rest state and elastically bendable away from the straight form, as defined elsewhere in the application.

In a preferred embodiment, each said load bearing member is parallel with the length direction of the rope. Furthermore, it is preferable that said reinforcing fibers are parallel with the length direction of the rope. Thereby the fibers are also parallel with the longitudinal direction of the rope as each load bearing member is oriented parallel with the longitudinal direction of the rope. This facilitates further the longitudinal stiffness of the rope, but also elasticity of bending. In the context of this kind of material the arrangement and method for installation is particularly advantageous as the downsides of tendency to straighten, caused by stiffness of the material, can thus be alleviated.

In a preferred embodiment, each said rope is belt shaped.

In a preferred embodiment, the reinforcing fibers of each load bearing member are distributed in the polymer matrix of the load bearing member in question and bound together by it to form a one integral piece. The reinforcing fibers of each load bearing member are then preferably substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated. Preferably, the load bearing members cover together over proportion 50% of the cross-section of the rope.

In a preferred embodiment, the module of elasticity E of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life. With this kind of material of the load bearing members, the tendency to straighten is particularly strong, whereby in this context the measures for alleviating the problems of straightening of rope during installation are particularly advantageous.

In a preferred embodiment, the matrix comprises epoxy.

In a preferred embodiment, the rope wheel arrangement comprises a frame mounted on the fixed base, such as a fixed structure of the hoistway (preferably the floor of the hoistway), on which the one or more rope wheels, are mounted.

In a preferred embodiment, before ropes are arranged to pass via the rope guides in the method the first rope guide and the second rope guide are mounted detachably on a frame on which the one or more rope wheels are also mounted.

In a preferred embodiment, the rope guides are detached and removed at a suitable moment after ropes have been connected with both the elevator car and the counterweight. In this case, the rope guides are preferably particularly detached from the frame of the rope wheel arrangement and removed from the site.

In a preferred embodiment, the position of both the first rope guide and the second rope guide is adjusted. Particularly, it is preferable that the horizontal distance between the first rope guide and the second rope guide is adjusted such that said one or more guide rollers of the first rope guide and said one or more guide rollers of the second rope guide comprise a guide roller for limiting the horizontal distance of the sections of each rope on opposite sides (before and after) of the one or more rope wheels, each of which guide rollers for limiting said horizontal distance is mounted at least partially on top of said one or more rope wheels (in particular such that their vertical projections at least partially overlap), and the rope is arranged to pass to the one or more rope wheels as well as away from said one or more rope wheels between said guide rollers for limiting said horizontal distance.

In a preferred embodiment, each rope passes around said one or more rope wheels turning around an axis extending in width direction of the rope.

In a preferred embodiment, each of said one or more ropes passes around the one or more rope wheels the side thereof which faces in thickness direction and extends in width direction of the of the rope, resting against the rope wheel.

The hoisting apparatus is preferably and elevator. The elevator is preferably such that the car thereof is arranged to serve two or more landings. The elevator preferably controls movement of the car in response to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which FIG. 1 an arrangement for installing a set of elevator ropes, wherein the ropes are arranged to pass around rope wheels without using rope guides.

The foregoing aspects, features and advantages of the invention will be apparent from the drawings and the detailed description related thereto.

DETAILED DESCRIPTION

Figure 1:
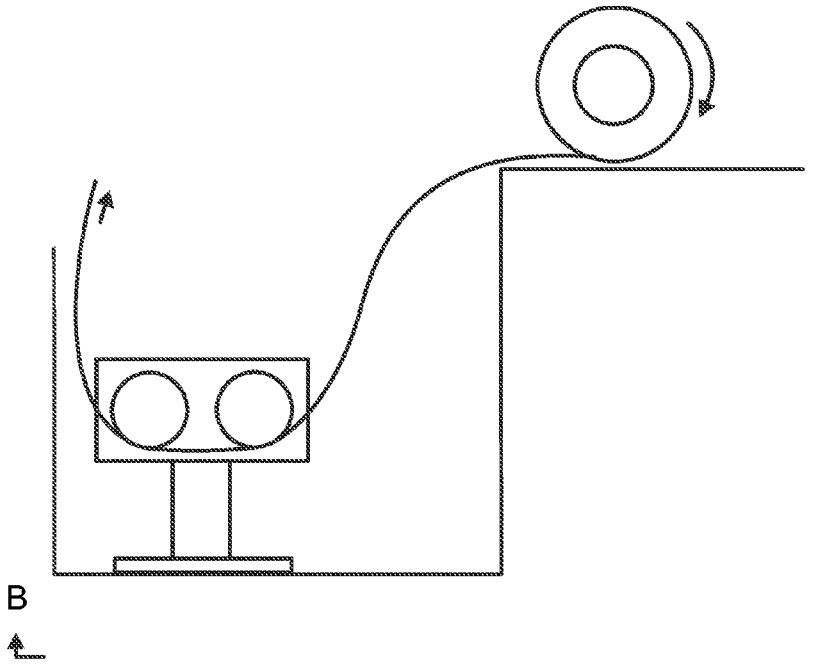

FIG. 1 illustrates an arrangement for installing a set of elevator ropes, wherein the ropes are arranged to pass around rope wheels without using rope guides as will be described hereinafter. The tendency of the ropes to straighten reduces the length of the contact between them and the rope wheels whereby they are difficult to control. The guidance of the ropes by the outer shape of the rope wheels is difficult.

Figure 2:
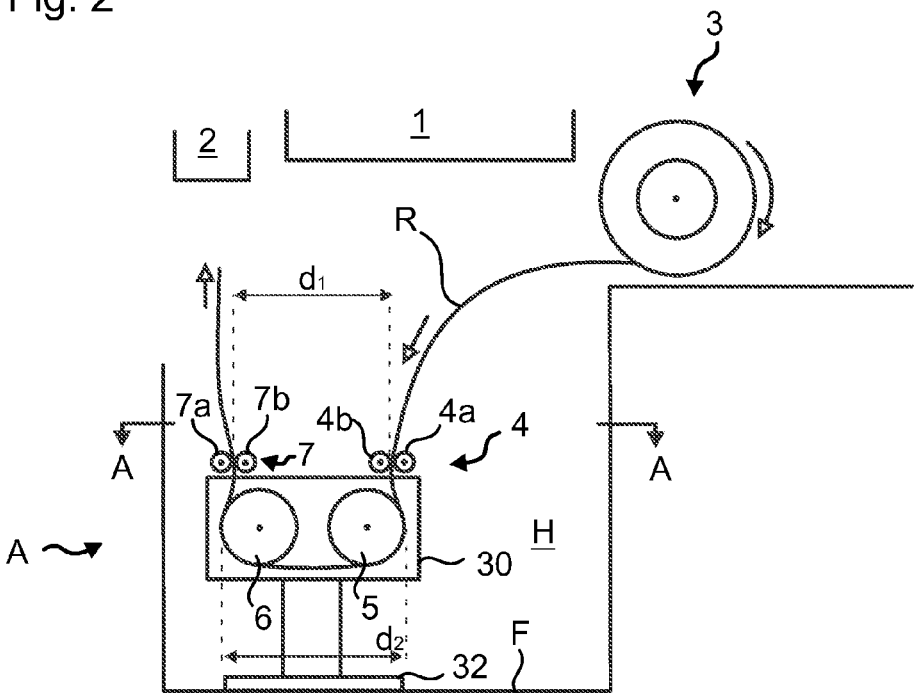
FIG. 2 illustrates an arrangement for installing a set of elevator ropes according to a preferred embodiment.

FIG. 2 illustrates an arrangement for installing a set of elevator ropes R according to a preferred embodiment. The ropes are rigid against bending, whereby they are difficult to guide during installation process thereof. Particularly, each said rope R is a rod having a straight form (when in rest state) and elastically bendable away from the straight form. In rest state no external force is exerted on the rope R, whereby the rope R as specified returns back to its original form after being bent due to tension produced in the rope R in said bending. The arrangement comprises one or more rope reels 3 storing the set of elevator ropes R provided on the installation site, in this case on the lowermost platform of the building wherein the elevator is located. Said set of elevator ropes R may comprise one or more ropes. In case the set comprises plural number of ropes R, then it is preferable that said one or more rope reels comprises plural rope reels 3.

The arrangement comprises a rope wheel arrangement A mounted on a fixed base F comprising one or more freely rotating non-driven rope wheels 5,6 for guiding ropes R of the elevator. The arrangement A is in the illustrated arrangement mounted in proximity of the lower end of the hoistway H, and the ropes R being installed are the lower ropes of the elevator meant to pass around said rope wheels 5,6. In the presented case, there are two of said rope wheels 5,6, a first and a second rope wheel 5,6 for guiding ropes R of the elevator, whereby each rope R is arranged to pass around a first and second rope wheel 5,6 for guiding ropes R of the elevator.

The ropes R of the type tending to straighten can be problematic to install. So as to alleviate problems caused by straightening of the ropes R during installation, the elevator is provided with detachable rope guides 4 and 7. More specifically, the arrangement further comprises a first rope guide 4 detachably mounted in proximity of said rope wheels 5, 6 of the rope wheel arrangement A; and a second rope guide 7 detachably mounted in proximity of said one or more rope wheels 5, 6 of the rope wheel arrangement A. So as to provide said detachability, the arrangement preferably comprises releasable tightening means T such as bolts 33 and nuts 35 for each of said rope guides 4,7 by which the guide 4,7 is detachably mounted in its mounting position, preferably on a frame 30 of the arrangement A, provided with structure (here holes 34) forming counterpart for said tightening means (here bolts). The ropes R of the set of elevator ropes being installed are arranged (in following order) to pass from the one or more rope reels 3 storing the ropes to said rope wheels 5, 6 of the rope wheel arrangement A via the first rope guide 4, which is arranged to guide the ropes R to converge a rim of said rope wheels 5, 6 (here a rim on the first rope wheel 5) at least substantially vertically (i.e. in at least substantially vertical direction; in this case from above), and to turn around said rope wheels 5,6, and to pass away from the rope wheels 5,6 via the second rope guide 7, which is arranged to guide the ropes R to diverge from a rim of said one or more rope wheels 5, 6 (here a rim of the second rope wheel 6) at least substantially vertically (i.e. in at least substantially vertical direction; in this case upwards). Thus, a controlled passage as well as a long contact length and pressure between the wheel and the rope can be ensured with the rope R as defined.

Structurally, the rope wheel arrangement A comprises a frame 30 mounted on the fixed base F, such as a fixed structure of the hoistway H. Said fixed structure is preferably the floor of the hoistway H. The rope wheels 5,6, as well as the first rope guide 4 and the second rope guide 7 are mounted on this frame 30. Thereby, their positions relative to each other can be set and maintained accurately. In the illustrated case, the frame is mounted on the fixed base F via a mounting means 32. The frame 30 may be mounted with the mounting means 32 on the fixed base F either immovably or movably with a limited range of movement. In case the frame 30 is mounted moveably, the movability is preferably realized in vertical direction, the range of movement being less than 2 meters more preferably less than 1 meter, whereby the rope wheels 5,6 can move so as to adopt to various situations during elevator use, such as rope elongation. The moveability is not shown in the Figures, but it can be provided for as known in prior art of compensator devices, for example by designing the mounting means 32 to allow said movement, e.g. to comprise a guide rail for the frame 30 along which the latter can move vertically.

Figure 3:
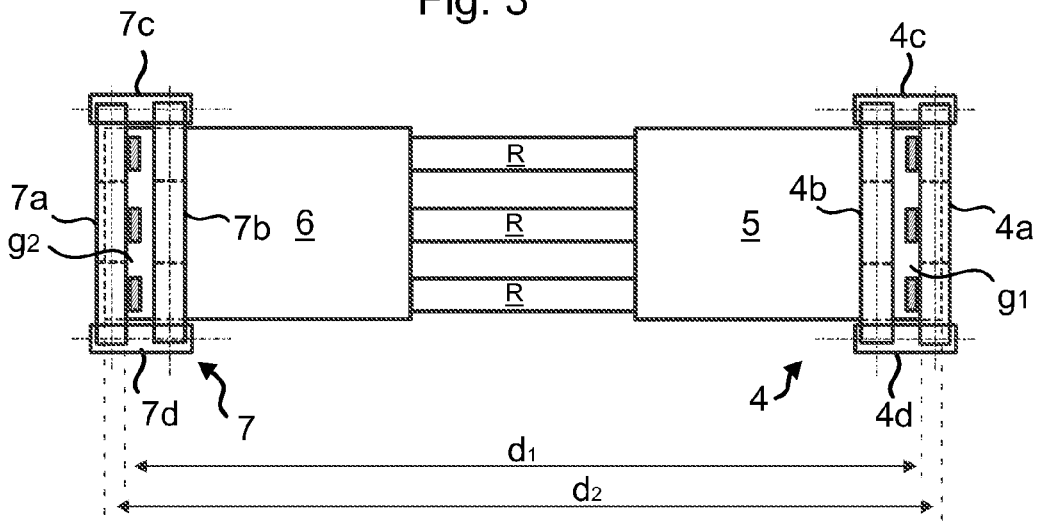
FIG. 3 illustrates preferred details of the rope wheel arrangement of FIG. 2 as viewed along cross section A-A of FIG. 2.

As illustrated in FIG. 2 the rope guides 4,7 comprise guide rollers for guiding the ropes to pass as described above. The rollers are non-driven and rotatable around a horizontal axis. FIG. 3 illustrates a preferred detailed configuration for the guide rollers of FIG. 2. The first rope guide 4 comprises guide rollers 4*a*,4*b*,4*c*,4*d* with which it is arranged to guide the ropes R to converge at least substantially vertically a rim of the 'first' rope wheel 5 belonging to said one or more rope wheels 5, 6, and the second rope guide 7 comprises guide rollers 7*a*,7*b*,7*c*,7*d* with which it is arranged to guide the ropes R to diverge at least substantially vertically from a rim of the 'second' rope wheel 6 belonging to said one or more rope wheels 5, 6.

The first and second rope guide 4,7 are arranged to limit with guide rollers 4*a*,7*a* the horizontal distance d1 between the sections of each rope R on opposite sides (i.e. before and after) of the one or more rope wheels 5,6 to be less than the horizontal distance d2 between the opposite rim sides of the rope wheels 5,6, which is in this case the horizontal distance between the farthermost rim points of the two rope wheels 5,6. Thus, even when the rope R is as described, a controlled passage of the rope R can be ensured such that a long contact length and pressure between the rope wheel 5,6 and the rope R is adequate to enable rope wheels 5,6 to guide the ropes to a correct path in their axial direction by a cambered shape. For the purpose of said limiting, in the preferred embodiment illustrated, said one or more guide rollers 4*a*,4*b*,4*c*,4*d* of the first rope guide 4 and said one or more guide rollers 7*a*,7*b*,7*c*,7*d* of the second rope guide 7 comprise a guide roller 4*a*, 7*a* for limiting the horizontal distance d1 between the sections of each rope R on opposite sides (before and after) of the rope wheels 5,6. Each the guide rollers 4*a*,7*a* for limiting said horizontal distance d1 is mounted at least partially on top of said rope wheels 5,6 (in particular such that their vertical projections at least partially overlap), and the rope R is arranged to pass to the rope wheels 5,6 as well as away from said the one or more rope wheels 5,6 between said guide rollers 4*a*,7*a* for limiting said horizontal distance d1, in particular via a space between these rollers 4*a*,7*a*.

So as to limit the position of the ropes R in several directions, and thereby to block passage of the ropes R laterally away from their intended path, said guide rollers 4*a*,4*b*,4*c*,4*d* of the first rope guide 4 comprise rollers 4*a*,4*b* having parallel rotational axis, in particular horizontal, with each other and with said rope wheels 5,6 and delimiting a gap g1 in thickness direction of the ropes R via which gap g1 the ropes R are arranged to pass from the one or more rope reels 3 to said one or more rope wheels 5, 6. Correspondingly, said guide rollers 7*a*,7*b*,7*c*,7*d* of the second rope guide 7 comprise rollers 7*a*,7*b* having parallel rotational axis with each other and with said one or more rope wheels 5,6 and delimiting a gap g2 in thickness direction of the ropes R via which gap g2 the ropes R are arranged to pass away from the rope wheels 5,6. Moreover, said guide rollers 4*a*,4*b*,4*c*,4*d* of the first rope guide 4 comprise rollers 4*c*,4*d* having parallel (horizontal) rotational axis with each other and orthogonal with said rope wheels 5,6 and delimiting said gap g1 in width direction of the ropes via which gap g1 the ropes R are arranged to pass from the one or more rope reels 3 to said rope wheels 5, 6, and said guide rollers 7*a*,7*b*,7*c*,7*d* of the second rope guide 7 comprise rollers 7*c*,7*d* having parallel rotational axis with each other and orthogonal with said rope wheels 5,6 and delimiting the gap g2 in width direction of the ropes R via which gap g2 the ropes R are arranged to pass away from the rope wheels 5,6.

Figure 4:
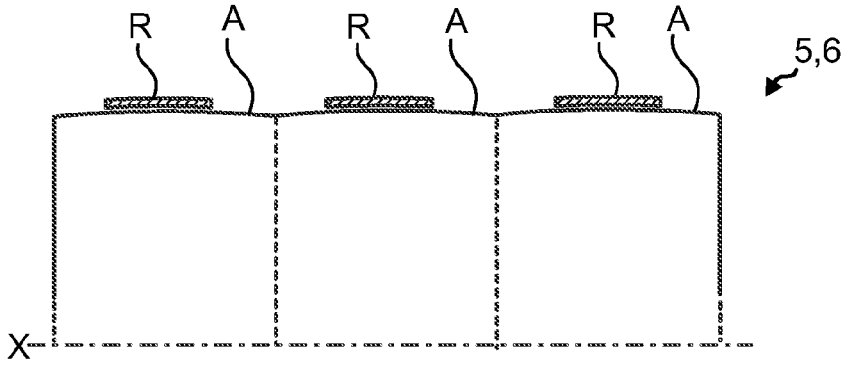
FIG. 4 illustrates preferred details of the rope wheels of the rope wheel arrangement of FIG. 2 as viewed along radially extending cross-section of the rope wheel.

Said rope wheels 5, 6 are preferably as illustrated in FIG. 4. That is, said rope wheels 5, 6 are cambered rope wheels comprising a cambered circumferential rope contact area A for each of said ropes R against which cambered circumferential rope contact area A the rope R in question is arranged to pass.

Each of said rope wheels 5,6 may be manufactured to be of any known type, for instance to be in the form of a one-piece wheel or a wheelpack-type of wheel. Accordingly, it is preferable that each of said rope wheels 5,6 is formed to be in the form of a one-piece wheel element having plural circumferential rope contact areas A, in particular one circumferential rope contact area A for each of the ropes R of the set of elevator ropes R that passes/is arranged to pass around the rope wheel 5,6 in question, or alternatively, each of said rope wheels 5,6 can be formed to be in the form of a wheelpack formed of plural wheel elements coaxially connected to each other, in particular one element being provided for each of the ropes of the set of elevator ropes R that passes/is arranged to pass around the rope wheel 5,6 in question, each element having only one of said circumferential rope contact areas A. In FIG. 4 the interface between adjacent wheel elements of the wheelpack forming the rope wheel is illustrated with a dashed line, because this type of construction of the rope wheel is optional.

The arrangement is after the stage illustrated in FIG. 2 brought to be such that each rope R, in particular an end thereof, is connected to the counterweight 2 or alternatively to some other rope lifting means vertically moveable in the hoistway H for lifting the ropes R in the hoistway H and thereby producing pulling effect on the ropes R. Thus rope R can be unwound and run via the arrangement A effectively. Said end of the rope R is the 'first' end of the rope R, which is positioned on opposite side of the arrangement A than the rope reels 3. Each rope is such that it has two ends. The 'second' end of each rope R is still on the rope reel 3.

Figure 5:
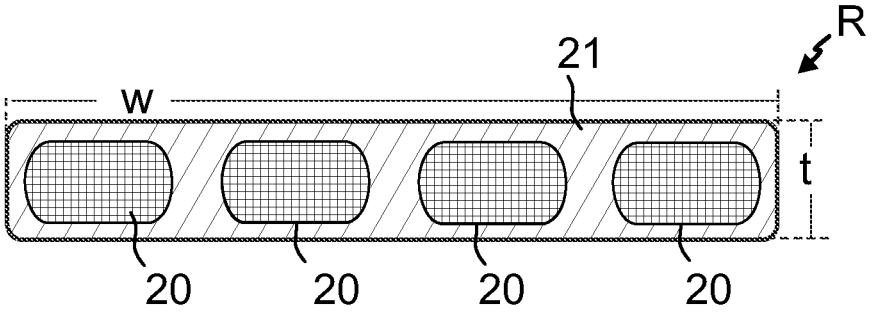
FIG. 5 illustrates a cross section of a rope to be installed as viewed in longitudinal direction of the rope.

The ropes R are preferably belt-shaped, and thereby substantially larger in width direction w than in thickness direction t. Thereby the total resistance of the rope against bending around an axis extending in width direction w of the hoisting rope R is reduced. The width/thickness-ratio of the rope R is preferably at least 2 whereby the advantages related to the bending resistance become clearly substantial. FIG. 5 illustrates a preferred cross-section of the rope R as seen in longitudinal direction thereof. The rope R comprises a coating 21, and a plurality of adjacent load bearing members 20 for bearing the load exerted on the rope in longitudinal direction thereof embedded in the coating 21 and extending parallel to each other and to the longitudinal direction of the hoisting rope unbroken throughout the length of the rope R. The coating 21 forms the surface of the rope R and extends between adjacent load bearing members 21 thereby isolating them from each other. The rope could alternatively have some other number of load bearing members 21, either more or less than what is disclosed in FIG. 5.

The load bearing members 20 are each formed to be such that it is in the form of a straight rod when in rest state, i.e. when no external force is exerted on it, and elastically bendable away from the straight form. Owing to this property of the load bearing members 20 of the rope R, the rope R will have this same property as well. Said qualities are obtained for the load bearing members for example with a preferred structure wherein the load bearing members 20 are in the form of fiber reinforced composite members. The load bearing members 20 are in this case preferably each made of composite material comprising reinforcing fibers F in polymer matrix m. The preferred material and internal structure of the composite members 20 will be discussed in further detail elsewhere in the application.

Figure 6:
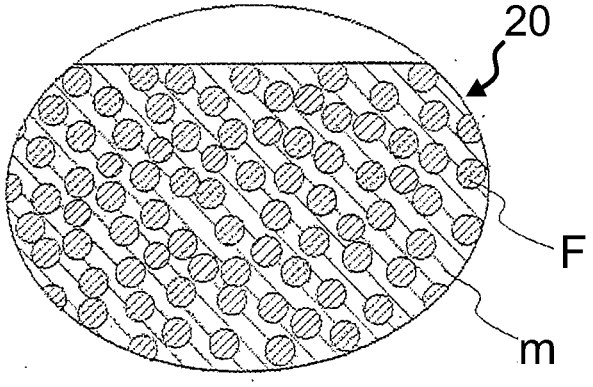
FIG. 6 illustrates partially a cross-section of a load bearing member as viewed in longitudinal direction of the rope and the load bearing member.

FIG. 6 illustrates a preferred inner structure of the load bearing member 20, showing in particular the cross section of the load bearing member 20 as viewed in the longitudinal direction I of the load bearing member 20. As mentioned, the load bearing members 20 are made of composite material comprising reinforcing fibers F embedded in polymer matrix m. The reinforcing fibers F are more specifically distributed in polymer matrix m and bound together by the polymer matrix, particularly such that an elongated rod-like piece is formed. Thus, each load bearing member 20 is one solid elongated rodlike piece. The reinforcing fibers F are distributed preferably substantially evenly in the polymer matrix m. Thereby a load bearing member with homogeneous properties and structure is achieved throughout its cross section. In this way, it can be also ensured that each of the fibers can be in contact and bonded with the matrix m. Said reinforcing fibers F are most preferably carbon fibers, but alternatively they can be glass fibers, or possibly some other fibers. The matrix m comprises preferably epoxy, but alternative materials could be used depending on the preferred properties. Preferably, substantially all the reinforcing fibers F of each load bearing member 20 are parallel with the longitudinal direction of the load bearing member 20. Thereby the fibers are also parallel with the longitudinal direction of the hoisting rope R as each load bearing member is oriented parallel with the longitudinal direction of the hoisting rope R. This is advantageous for the longitudinal rigidity as well as behavior of the internal structure in bending.

The preferred inner structure of the load bearing member 20 is preferably as described in the following, wherein the structure is explained in further preferred details by still referring to FIG. 6. Each load bearing member 20 is an elongated rod-like piece wherein the fibers F are parallel with the longitudinal direction of the load bearing member 20, and thereby parallel with the longitudinal direction of the rope R, as each load bearing member 20 is oriented parallel with the longitudinal direction of the rope R. Thereby, the fibers in the final rope R will be aligned with the force when the rope R is pulled, which ensures that the structure provides high tensile stiffness. The fibers F used in the preferred embodiments are substantially untwisted in relation to each other, which provides them said orientation parallel with the longitudinal direction of the rope R. This is in contrast to the conventionally twisted elevator ropes, where the wires or fibers are strongly twisted and have normally a twisting angle from 15 up to 30 degrees, the fiber/wire bundles of these conventionally twisted elevator ropes thereby having the potential for transforming towards a straighter configuration under tension, which provides these ropes a high elongation under tension as well as leads to an unintegral structure.

The reinforcing fibers F are preferably long continuous fibers in the longitudinal direction of the load bearing member, the fibers F preferably continuing for the whole length of the load bearing member 20 as well as the rope R. Thus, the load bearing ability as well as manufacturing of the load bearing member 20 is facilitated. The fibers F being oriented parallel with longitudinal direction of the rope R, as far as possible, the cross section of the load bearing member 20 can be made to continue substantially the same in terms of its cross-section for the whole length of the rope R. Thus, no substantial relative movement can occur inside the load bearing member 20 when it is bent.

As mentioned, the reinforcing fibers F are preferably distributed in the aforementioned load bearing member 20 substantially evenly, in particular as evenly as possible, so that the load bearing member 20 would be as homogeneous as possible in the transverse direction thereof. An advantage of the structure presented is that the matrix m surrounding the reinforcing fibers F keeps the interpositioning of the reinforcing fibers F substantially unchanged. It equalizes with its slight elasticity the distribution of a force exerted on the fibers, reduces fiber-fiber contacts and internal wear of the rope, thus improving the service life of the rope R. The composite matrix m, into which the individual fibers F are distributed as evenly as possible, is most preferably made of epoxy, which has good adhesiveness to the reinforcement fibers F and which is known to behave advantageously with carbon fiber. Alternatively, e.g. polyester or vinyl ester can be used, but alternatively any other suitable alternative materials can be used. FIG. 6 presents a partial cross-section of the load bearing member 20 close to the surface thereof as viewed in the longitudinal direction of the rope R presented inside the circle in the FIG. 6 according to which cross-section the reinforcing fibers F of the load bearing member 20 are preferably organized in the polymer matrix m. The rest (parts not showed) of the load bearing member 20 have a similar structure. FIG. 5*a* presents also how the individual reinforcing fibers F are substantially evenly distributed in the polymer matrix m, which surrounds the reinforcing fibers F and which is fixed to the reinforcing fibers F. The polymer matrix m fills the areas between individual reinforcing fibers F and binds substantially all the reinforcing fibers F that are inside the matrix m to each other as a uniform solid substance. A chemical bond exists between, the individual reinforcing fibers F (preferably each of them) and the matrix m, one advantage of which is uniformity of the structure. To improve the chemical adhesion of the reinforcing fiber to the matrix m, in particular to strengthen the chemical bond between the reinforcing fiber F and the matrix m, each fiber can have a thin coating, e.g. a primer (not presented) on the actual fiber structure between the reinforcing fiber structure and the polymer matrix m.

However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer as in this case a risk of buckling can be reduced for instance. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance. The reinforcing fibers F being in the polymer matrix means here that the individual reinforcing fibers F are bound to each other with a polymer matrix m, e.g. in the manufacturing phase by immersing them together in the fluid material of the polymer matrix which is thereafter solidified. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. As mentioned, the reinforcing fibers are preferably distributed substantially evenly in the polymer matrix m, whereby the load bearing member is as homogeneous as possible when viewed in the direction of the cross-section of the rope. In other words, the fiber density in the cross-section of the load bearing member 20 does not therefore vary substantially.

The reinforcing fibers F together with the matrix m form a uniform load bearing member, inside which abrasive relative movement does not occur when the rope is bent. The individual reinforcing fibers of the load bearing member 20 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers F can be pre-coated with material of the matrix m such that a coating of polymer material of said matrix is around each of them already before they are brought and bound together with the matrix material, e.g. before they are immersed in the fluid matrix material.

As above mentioned, the matrix m of the load bearing member 20 is most preferably hard in its material properties. A hard matrix m helps to support the reinforcing fibers f, especially when the rope bends, preventing buckling of the reinforcing fibers F of the bent rope, because the hard material supports the fibers F efficiently. To reduce the buckling and to facilitate a small bending radius of the load bearing member 20, among other things, it is therefore preferred that the polymer matrix m is hard, and in particular non-elastomeric. The most preferred materials for the matrix are epoxy resin, polyester, phenolic plastic or vinyl ester. The polymer matrix m is preferably so hard that its module of elasticity (E) is over 2 GPa, most preferably over 2.5 GPa. In this case the module of elasticity E is preferably in the range 2.5-10 GPa, most preferably in the range 2.5-3.5 GPa. There are commercially available various material alternatives for the matrix m which can provide these material properties. Preferably over 50% of the surface area of the cross-section of the load bearing member 20 is of the aforementioned reinforcing fiber, preferably such that 50%-80% is of the aforementioned reinforcing fiber, more preferably such that 55%-70% is of the aforementioned reinforcing fiber, and substantially all the remaining surface area is of polymer matrix. Most preferably, this is carried out such that approx. 60% of the surface area is of reinforcing fiber and approx. 40% is of matrix material (preferably epoxy material). In this way a good longitudinal stiffness for the load bearing member 20 is achieved. As mentioned carbon fiber is the most preferred fiber to be used as said reinforcing fiber due to its excellent properties. However, this is not necessary as alternative fibers could be used, such as glass fiber, which has been found to be suitable for the hoisting rope as well.

In the illustrated embodiments, the load bearing members 20 are substantially rectangular. However, this is not necessary as alternative shapes could be used.

Figure 8:
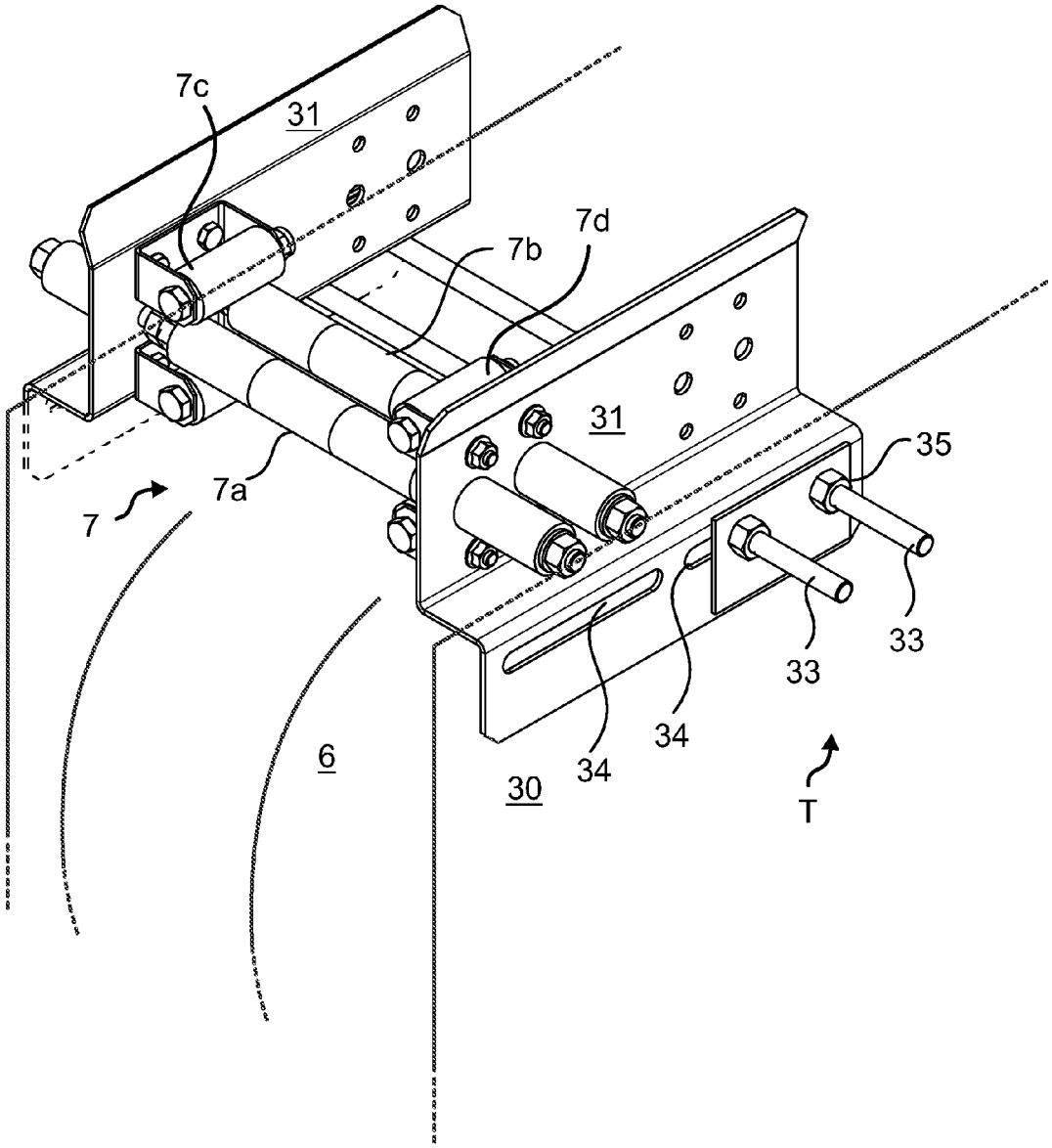
FIG. 8 illustrates preferred details of the rope wheel arrangement.

FIG. 8 illustrates a preferred implementation of the rope guides 4,7 and the frame 30 disclosed in FIGS. 2 and 3. In this case, the rope wheel arrangement A comprises a frame 30 mounted, as already described on the fixed base F, and said one or more rope wheels 5,6 are mounted detachably on the frame 30. In the preferred implementation in accordance with FIG. 8, the first rope guide 4 and the second rope guide 7 comprise each a support frame 31 via which it is detachably mounted on the frame 30. As mentioned, so as to enable said detachability the arrangement comprises releasable tightening means T, in this case bolts 33 and nuts 35, for each of said guides 4,7 by which the guide 4,7 is detachably mounted in its mounting position, in this case on the frame 30. The arrangement, in this case the frame 30, comprises a structure forming counterpart for said releasable tightening means, in this case holes 34 for receiving bolts 35 of the releasable tightening means T. Owing to the detachability, the rope guides 4,7 can be detached and removed after the installation.

As a further feature, the position of both the first rope guide 4 and the second rope guide 7 is adjustable. Thereby, also the horizontal distance between the first rope guide 4 and the second rope guide 7 is adjustable. For this purpose the frame 30 comprises several mounting locations where the rope guides 4,7 can be detachably mounted. This is implemented preferably such that said holes 34 are elongated in horizontal direction, as illustrated. FIG. 8 illustrates only the surroundings of the second rope guide 7, but the surroundings of the first rope guide 4 are preferably similar except reversed.

In the method for installing a set of elevator ropes R to pass around one or more rope wheels 5,6 of a rope wheel arrangement A mounted on fixed base F, an arrangement as illustrated in FIG. 2 is provided, and thereafter the ropes R are pulled via said rope wheel arrangement A, while at the same time, rope R is unwound from one or more rope wheels 3. More specifically the method proceeds as follows. At first one or more rope reels 3 storing the set of elevator ropes R are provided. The ropes R are of the type above described, i.e. each rope R is a rod having a straight form when in rest state and elastically bendable away from the straight form. The ropes R are subsequently arranged to pass from the one or more rope reels 3 to said one or more rope wheels 5, 6 of the rope wheel arrangement A via a first rope guide 4 detachably mounted in proximity of said one or more rope wheels 5, 6 of the rope wheel arrangement A, and to turn around said one or more rope wheels (5,6); and to pass away from the one or more rope wheels 5,6 via a second rope guide 7 detachably mounted in proximity of said one or more rope wheels 5, 6 of the rope wheel arrangement A. The ropes R are guided to converge the rim of said one or more rope wheels 5, 6 at least substantially vertically with one or more guide rollers 4*a*,4*b* of said first rope guide 4, and to diverge from the rim of said one or more rope wheels 5, 6 at least substantially vertically with one or more guide rollers 7*a*,7*b* of the first rope guide 7.

In the method, the first rope guide 4 comprises one or more guide rollers 4*a*,4*b*,4*c*,4*d* with which the ropes R are guided to converge the rim of a first rope wheel 5 belonging to said one or more rope wheels 5, 6 at least substantially vertically and the second rope guide 7 comprises one or more guide rollers 7*a*,7*b*,7*c*,7*d* with which the ropes R are guided to converge the rim of a second rope wheel 6 belonging to said one or more rope wheels (5, 6) at least substantially vertically.

The horizontal distance d1 of the sections of each rope R on opposite sides (before and after) of the one or more rope wheels 5,6 the first and second rope guide 4,7 is limited with the rope guides 4,7, particularly with one or more guide rollers 4*a*,7*a* thereof, to be less than the horizontal distance d2 between the opposite rim sides of the one or more rope wheels 5,6, the distance being the horizontal distance d2 between the farthermost rim points of the one or more rope wheels 5,6. This way, the pressure and length of contact between the rope R and the rope wheels 5,6 is adequate even for the most sensitive means of guidance of the ropes R. Thus, for instance guidance of the ropes by cambered shape of the rope wheels can be reliably used with ropes that tend to straighten when in rest state.

Said one or more guide rollers 4*a*,4*b*,4*c*,4*d* of the first rope guide 4 and said one or more guide rollers 7*a*,7*b*,7*c*,7*d* of the second rope guide 7 comprise a guide roller 4*a*, 7*a* for limiting the horizontal distance d1) of the sections of each rope R on opposite sides (before and after) of the one or more rope wheels 5,6, each of which guide rollers 4*a*,7*a* for limiting said horizontal distance d1 is mounted at least partially on top of said one or more rope wheels 5,6 (in particular such that their vertical projections at least partially overlap), and the rope R is arranged to pass to the one or more rope wheels 5,6 as well as away from said one or more rope wheels 5,6 between said guide rollers 4*a*,7*a* for limiting said horizontal distance d1.

After ropes R are arranged to pass in the way described above, the ropes R are pulled such that they run via said rope wheel arrangement A. At the same time, rope is unwound from said one or more rope wheels 3. Thereafter, the first and second rope guide 4,7 are detached and removed.

Said unwinding can comprise one or more actions causing unwinding. Said one or more actions can comprise said pulling and/or rotating of the rope reels 3 for example. Thus the unwinding can be produced by said pulling and/or by rotating the rope reels. In case the unwinding is to be produced with said pulling, said unwinding can further comprise a step of simultaneous resisting of the unwinding, whereby a counterforce for said pulling is produced and thus better control for the unwinding is achieved as the unwinding is controllable with said pulling as the rope R does not unwound by itself e.g. due to gravity and/or its tendency to straighten.

So as to orchestrate said pulling, the method further preferably comprises a step of connecting an end of each rope R to the counterweight 2 or alternatively to some other rope lifting means vertically moveable in the hoistway H, and thereafter moving the counterweight 2 or said alternative rope lifting means vertically in the hoistway H, thereby lifting the ends of the ropes R and producing pulling effect on them. Said end of the rope R is the 'first' end of the rope R, which is positioned on opposite side of the arrangement A than the rope reels 3. Each rope is such that it has two ends. During the steps of connecting and pulling, the 'second' end of each rope R is still on the rope reel 3.

In the method, at a suitable point, each rope R is connected on one side of the arrangement A to the counterweight 2 and on the other side to the elevator car 1. Each rope R is brought to be connected in this way with both the car 1 and counterweight 2 when an adequate amount of rope R is unwound from the rope reels 3 by said pulling. The 'first' end may have been connected earlier than the 'second' end, such as in context of orchestrating said pulling. The 'second' end of each rope R is during this step of connecting moved away from the reel 3 and fixed to the elevator car 1.

As mentioned earlier above, each said rope R is preferably belt-shaped and comprises one or more load bearing members 20 formed to be such that it is in the form of a straight rod when in rest state, i.e. when no external force is exerted on it, and elastically bendable away from the straight form. Owing to this property of the load bearing members 20 of the rope R, the rope R will have this same property as well. As mentioned, load bearing members 20 extend parallel to the longitudinal direction of the rope R unbroken throughout the length of the rope R, and said one or more load bearing members 20 is/are preferably made of composite material comprising reinforcing fibers F in polymer matrix m, said reinforcing fibers preferably being carbon fibers. Also as mentioned earlier above, said one or more rope wheels 5, 6 is/are preferably cambered rope wheel(s) comprising a cambered circumferential rope contact area A for each of said ropes R against which cambered circumferential rope contact area A the rope R in question passes/is arranged to pass. Further preferable details are discloses elsewhere in the application.

The rope guides 4,7 are preferably used only for the purposes of the installation. For this purpose, before ropes R are guided via the rope guides 4,7 in the method the rope guides 4,7 are mounted detachably on the frame 30 of the arrangement A, and at the end of the installation method, i.e. after ropes have been connected with the car and counterweight 2, the rope guides 4,7 are detached from the frame 30 of the rope wheel arrangement A and removed from the site.

As mentioned, it is preferable that the position of both the first rope guide and the second rope guide is adjustable. Thereby, the horizontal distance between the first rope guide 4 and the second rope guide 7 is adjustable. This is utilized in the method preferably such that, when attaching the rope guides 4,7 on the frame 30, the horizontal distance between the first rope guide 4 and the second rope guide 7 is adjusted such that said one or more guide rollers 4*a*,4*b*,4*c*,4*d* of the first rope guide 4 and said one or more guide rollers 7*a*,7*b*,7*c*,7*d* of the second rope guide 7 have each a guide roller 4*a*, 7*a* for limiting the horizontal distance d1 of the sections of each rope R on opposite sides (before and after) of the one or more rope wheels 5,6, each of which guide rollers 4*a*,7*a* for limiting said horizontal distance d1 is at least partially on top of said one or more rope wheels 5,6 (in particular such that their vertical projections at least partially overlap). The rope R is arranged to pass to the one or more rope wheels 5,6 as well as away from said one or more rope wheels 5,6 between said guide rollers 4*a*,7*a* for limiting said horizontal distance d1. This way, the components can be brought to such a configuration that the pressure and length of contact is adequate for the most sensitive means of guidance of the ropes R. Thus, for instance guidance of the ropes by cambered shape of the rope wheels can be reliably used with ropes that tend to straighten when in rest state.

The arrangement and method for installing ropes R can be used for installing ropes R to an existing elevator that has already been under use for some time, e.g. for installing new ropes to an existing elevator to replace used ropes, or for installing new ropes R to an elevator under construction, i.e. as part of a method for installing an elevator. The ropes R being installed are preferably the lower ropes of the elevator, because in this context the tendency of straightening of the ropes would otherwise adversely affect the installation process most considerably. Particularly, passage of the ropes while being moved would otherwise need constant overseeing so that several persons would be needed to carry out the installation process.

Figure 7:
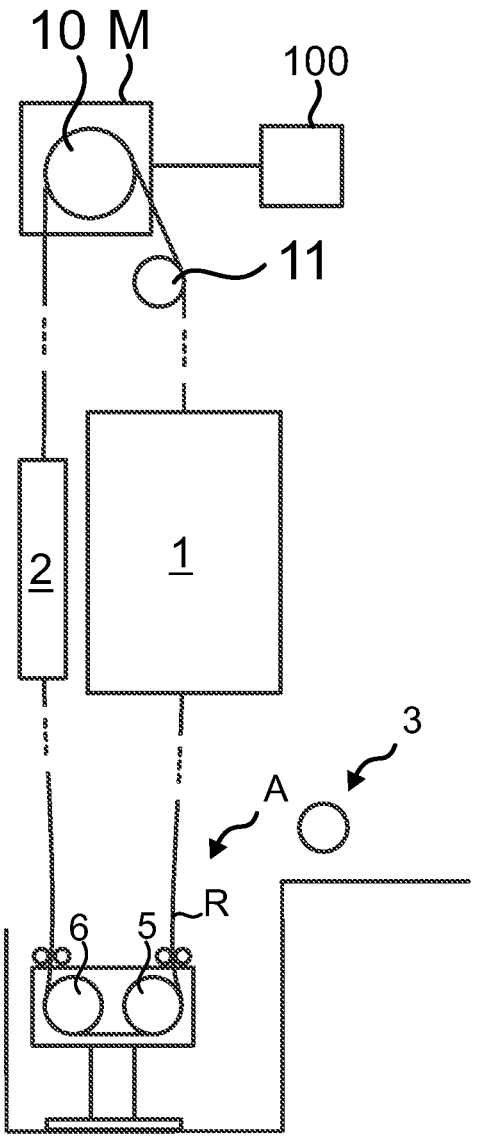
FIG. 7 illustrates schematically an elevator according to an embodiment as viewed from the side.

FIG. 7 illustrates an elevator obtained with the method described above and elsewhere in the application. As mentioned, the elevator may be a new one, or an existing elevator that has already been under use for some time. The elevator has been provided to be as follows. The elevator comprises a hoistway H, an elevator car 1 vertically movable in the hoistway H, and a counterweight 2 vertically movable in the hoistway H. The elevator further comprises one or more upper rope wheels 10,11 mounted higher than the car 1 and counterweight 2, in particular in proximity of the upper end of the hoistway H. In this case there are two of said rope wheels 10,11. The elevator further comprises upper ropes r interconnecting the elevator car 1 and counterweight 2, each of said one or more ropes r passing around said upper rope wheels 10,11. The first ropes r has been arranged to suspend the car 1 and counterweight 1 on opposite sides of said upper rope wheels 10,11. Preferably, said one or more upper rope wheels 10,11 comprises a drive wheel 10 engaging said first ropes, and the elevator further comprises a motor M for rotating the drive wheel 10. Thus, the elevator car 1 can be moved in motorized fashion. The elevator further comprises an automatic elevator control 100 arranged to control the motor M, whereby rotation of the drive wheel 10 and thereby also the movement of the car 1 is automatically controllable. The elevator further comprises a rope wheel arrangement A mounted on a fixed base F comprising one or more lower rope wheels 5,6 mounted lower than (i.e. in a lower position than) the car 1 and the counterweight 2, in particular in proximity of the lower end of the hoistway H, as well as ropes R (also later referred to as lower ropes) interconnecting the elevator car 1 and counterweight 2, each lower rope R passing around said one or more rope of the lower rope wheels 5,6. Said lower rope wheels 5,6 comprise in this case two adjacent rope wheels 5,6. The rope wheels 5,6 are positioned to have parallel horizontal rotational axes and to rotate along the same vertical plane, whereby rope can pass between their rims smoothly.

In the embodiments illustrated, the ropes R have been guided by a cambered shape of the rope wheels 5,6 around which they pass. The rope guides 4 and 7 solve problems particularly critical in this context. Some of the advantages of the solution can however be also obtained even though the ropes are guided alternative means, such by using polyvee-guidance. Should this kind of guidance be used, then each rope R has at least one contoured side provided with guide rib(s) and guide groove(s) oriented in the longitudinal direction of the rope R, said contoured side being fitted to pass against a contoured circumferential rope contact area of the (one or more) rope wheels 5,6 said rope contact area being provided with guide rib(s) and guide groove(s) so that said contoured circumferential rope contact area forms a counterpart for said contoured side of the rope R. Also in this context, a long contact as well as firm pressure between the rope wheel 5,6 and the ropes R is advantageous for proper guidance of the ropes in axial direction of the rope wheels 5,6.

In the embodiments illustrated, there are two of said one or more first rope wheels 5,6. However, there may be different number of said wheels 5,6. For example, said two rope wheels 5,6 could be substituted with a single rope wheel.

As mentioned, in the preferred embodiment one end of each rope R is fixed to the car 1 and the other end to the counterweight 2. In this case, it is preferable that all the lower ropes R extend vertically straight between the fixing point at the car and the lower rope wheel(s) around which they pass as well as vertically straight between the fixing point at the counterweight and the rope wheel(s) around which they pass. It is however possible to utilize the invention based on the disclosure of this application in elevator configuration wherein lower ropes are connected to the car and/or counterweight with ratio other than 1:1, such as 2:1.

As an alternative to the rope disclosed in detailed embodiments herein, the rope may be have the structure of any of the alternatives described in WO2009090299A1, such as in any of its FIGS. 1*a* to 1*m*.

The feature that the rope R is a rod having a straight form when in rest state and elastically bendable away from the straight form means at least that a 1.0 meter length of the straight rope R straightens back, i.e. into the straight form it had prior the bending, when released after a bending from straight form to a curved form, in which bending the rope R is bent along its complete length to a curved form with a radius within the range of 0.3-0.5 meter. Thereby the feature can be tested for example by bending the rope R in this way.

In the application, the definition that the ropes converge/diverge from a rim at least substantially vertically means that they converge/diverge from the rim in question exactly in vertical direction or at a slight angle from the exactly vertical, said slight angle being less than 10 degrees.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

What is claimed is:

1. An arrangement for installing a set of elevator ropes, the arrangement comprising:

one or more rope reels storing the set of elevator ropes; and a rope wheel arrangement mounted on a fixed base comprising one or more rope wheels;

a first rope guide detachably mounted in proximity of said one or more rope wheels of the rope wheel arrangement; and a second rope guide detachably mounted in proximity of said one or more rope wheels of the rope wheel arrangement, wherein the ropes of the set of elevator ropes are arranged:

to pass from the one or more rope reels to said one or more rope wheels of the rope wheel arrangement via the first rope guide, which is arranged to guide the ropes to converge toward a first rim of said one or more rope wheels at least substantially vertically; to turn around said one or more rope wheels; and to pass away from the one or more rope wheels via the second rope guide, which is arranged to guide the ropes to diverge from a second rim of said one or more rope wheels at least substantially vertically, wherein each of the first rope guide and the second rope guide comprises at least two guide rollers, and is configured to guide the rope by having the rope pass between the respective at least two guide rollers, wherein the first and second rope guides are arranged to limit a horizontal distance of the ropes to be less than a horizontal distance between opposite rim sides of the one or more rope wheels, the horizontal distance of the ropes being measured between a section of the ropes directly between the at least two guide rollers of the first rope guide and a section of the ropes directly between the at least two guide rollers of the second rope guide, wherein the at least two guide rollers for each of the first rope guide and the second rope guide each have a rotational axis parallel with each other and with rotational axes of the one or more rope wheels, and the at least two guide rollers for each of the first rope guide and the second rope guide define a gap in a thickness direction of the rope for the rope to pass through, and wherein each of the first rope guide and the second rope guide further comprises additional two guide rollers each having a rotational axis parallel with each other, and orthogonal with rotational axes of the one or more rope wheels, the additional two guide rollers defining the gap in a width direction of the rope for the rope to pass through.

2. The arrangement according to claim 1, wherein each rope is in a straight form when in a natural state and elastically bendable away from the straight form.

3. The arrangement according to claim 2, wherein said one or more rope wheels are cambered rope wheels comprising a cambered circumferential rope contact area for each of said ropes, and the ropes are arranged to pass against said cambered circumferential rope contact areas.

4. The arrangement according to claim 1, wherein said one or more rope wheels are cambered rope wheels comprising a cambered circumferential rope contact area for each of said ropes, and the ropes are arranged to pass against said cambered circumferential rope contact areas.

5. The arrangement according to claim 1, wherein each rope is connected to a counterweight vertically movable in the hoistway for lifting the ropes in the hoistway and thereby producing pulling effect on the ropes.

6. The arrangement according to claim 1, wherein the at least two guide rollers for each of the first rope guide and the second rope guide comprise a guide roller for limiting the horizontal distance of the sections of each rope on opposite sides of the one or more rope wheels, said guide roller being mounted at least partially on top of said one or more rope wheels, and the rope is arranged to pass to the one or more rope wheels as well as away from the one or more rope wheels between said at least two guide rollers for limiting said horizontal distance.

7. The arrangement according to claim 1, wherein the rope wheel arrangement comprises a frame on which the one or more rope wheels are mounted, which frame is mounted on the fixed base, and the first rope guide and the second rope guide are detachably mounted on said frame.

8. A method for installing a set of elevator ropes to pass around one or more rope wheels of a rope wheel arrangement mounted on a fixed base, said method comprising the steps of:

providing one or more rope reels storing the set of elevator ropes; and thereafter arranging the ropes of the set of elevator ropes:

to pass from the one or more rope reels to said one or more rope wheels of the rope wheel arrangement via a first rope guide detachably mounted in proximity of said one or more rope wheels of the rope wheel arrangement:

to turn around said one or more rope wheels; and to pass away from the one or more rope wheels via a second rope guide detachably mounted in proximity of said one or more rope wheels of the rope wheel arrangement, wherein the ropes are guided to converge toward a first rim of said one or more rope wheels at least substantially vertically with said first rope guide, and to diverge from a second rim of said one or more rope wheels at least substantially vertically with the second rope guide; and thereafter pulling the ropes such that the ropes run via said rope wheel arrangement; and thereafter detaching and removing the first and second rope guide, wherein each of the first rope guide and the second rope guide comprises at least two guide rollers, and is configured to guide the rope by having the rope pass between the respective at least two guide rollers, wherein the first and second rope guides are arranged to limit a horizontal distance of the ropes to be less than a horizontal distance between opposite rim sides of the one or more rope wheels, the horizontal distance of the ropes being measured between a section of the ropes directly between the at least two guide rollers of the first rope guide and a section of the ropes directly between the at least two guide rollers of the second rope guide, and wherein the at least two guide rollers for each of the first rope guide and the second rope guide each have a rotational axis parallel with each other and with rotational axes of the one or more rope wheels, and the at least two guide rollers for each of the first rope guide and the second rope guide define a gap in a thickness direction of the rope for the rope to pass through, and wherein each of the first rope guide and the second rope guide further comprises additional two guide rollers each having a rotational axis parallel with each other, and orthogonal with rotational axes of the one or more rope wheels, the additional two guide rollers defining the gap in a width direction of the rope for the rope to pass through.

9. The method according to claim 8, wherein each rope is in a straight form when in a natural state and elastically bendable away from the straight form.

10. The method according to claim 8, wherein during said pulling, at the same time, rope is unwound from said one or more rope reels.

11. The method according to claim 8, the at least two guide rollers for each of the first rope guide and the second rope guide comprise a guide roller for limiting the horizontal distance between the sections of each rope on opposite sides of the one or more rope wheels, said guide roller being mounted at least partially on top of said one or more rope wheels, and the rope is arranged to pass to the one or more rope wheels as well as away from said one or more rope wheels between said at least two guide rollers for limiting said horizontal distance.

12. The method according to claim 8, wherein each rope is connected on one side of the arrangement to the counterweight and on the other side to the elevator car, and the rope guides are detached and removed from the site.

13. The method according to claim 8, wherein before the ropes are arranged to pass via the rope guides, the first rope guide and the second rope guide are mounted detachably on a frame on which the one or more rope wheels are also mounted.

14. The method according to claim 8, wherein each rope is connected to a counterweight vertically movable in the hoistway, and thereafter said pulling is carried out by moving said rope lifting device vertically in the hoistway.

15. The method according to claim 8, wherein said one or more rope wheels are cambered rope wheels comprising a cambered circumferential rope contact area for each of said ropes, and the ropes are arranged to pass against said cambered circumferential rope contact areas.

16. The method according to claim 9, wherein said rope comprises one or more load bearing members extending parallel to the longitudinal direction of the rope unbroken throughout the length of the rope, which one or more load bearing members is/are made of composite material comprising reinforcing fibers in polymer matrix.

* * * * *